United States Patent [19]

Hight

[11] Patent Number: 4,991,722

[45] Date of Patent: Feb. 12, 1991

[54] PRODUCT DISPLAY HOOK

[76] Inventor: Gerry M. Hight, 13809 E. 29th St., Tulsa, Okla. 74134

[21] Appl. No.: 531,932

[22] Filed: Jun. 1, 1990

[51] Int. Cl.[5] ..... A47F 5/00

[52] U.S. Cl. ..... 211/59.1; 211/99; 211/106; 248/225.1

[58] Field of Search ..... 248/225.1, 222.1, 221.4, 248/221.2; 211/57.1, 59.1, 106, 99

[56] References Cited

U.S. PATENT DOCUMENTS

| | | | |
|---|---|---|---|
| 3,295,471 | 1/1967 | Cook | 211/106 X |
| 3,815,756 | 6/1974 | Cox | 248/221.4 X |
| 4,018,341 | 4/1977 | Jarecki | 211/59.1 |
| 4,375,880 | 3/1983 | Sinclair | 248/225.1 |
| 4,526,335 | 7/1985 | Garfinkle | 248/221.4 |
| 4,674,721 | 6/1987 | Thalenfeld | 211/59.1 X |

*Primary Examiner*—David L. Talbott
*Attorney, Agent, or Firm*—Head & Johnson

[57] ABSTRACT

A hook for displaying products in front of a shelf includes a bracket adapted to be mounted on the shelf, a bearing, a stop and a detent, a journal rotatable in the bearing between a product display position and a product clearing position, a product carrier connected to the journal to support products in a vertical hanging position in front of the shelf when the journal is in the display position and a prop connected to the journal which cooperates with the carrier to support the products in a horizontal position when the journal is rotated into the clearing position. The detent on the bracket is cooperable with the prop to prevent rotation of the journal out of the clearing position toward the display position and the prop may be disengaged from the detent of allow the journal to rotate back to the display position. A shield connected to the journal may also be provided which surrounds the carrier forward of the shelf. The prop may be sloped downward its midpoint to prevent the product from slipping off the prop while in the clearing position. A double bracket may be employed which may be inverted so that the display hook may be adapted to a greater number of shelf-front-face angle arrangements.

15 Claims, 2 Drawing Sheets

PRODUCT DISPLAY HOOK

BACKGROUND OF THE INVENTION

This invention relates generally to product display hooks and more particularly concerns display hooks used to hang specialty items in front of shelves stocked with other products.

The average consumer is very familiar with the hooks mounted on the front face of grocery and drugstore shelves for the display of lightweight specialty items from pens to potholders, from gadgets to widgets. This sales method has been found by marketing people to be very effective, but only when the hooks are kept properly stocked with product.

On the other hand, these devices are generally a source of frustration and consternation for stockboys who, in order to keep the shelves stocked, must first confront the product hanging on the hooks. Holding the dangling, swinging widgets out of the way with one hand, the stockboy restocks the shelf, often one box at a time, with the other. Usually, some of the widgets fall off the hooks and need to be rehung. The eventual responses of even the most conscientious stockboys are not unpredictable. Some simply refuse to restock the hooks, thus keeping access to the shelves clear. This response is effective until the store manager discovers that sales on hook displayed products are not up to expectations. Management's subsequent instruction that the hooks be properly stocked generally leads to discovery of the second response. At this juncture, management frequently finds that the hooks themselves are disappearing, usually to be later found behind the shelf stock where the hooks used to be. Or, when instructions are followed and hooks properly stocked, bringing shelf-stocking frustration to a peak, broken hooks and widgets will eventually both be found behind the shelf products, proof that even the best of us can sometimes be pushed just too far.

It is therefore an object of this invention to provide a display hook that facilitates the effective display of front-of-shelf products. At the same time, it is an essential object of this invention to minimize the obstruction of access to the shelf by the displayed product. Similarly, it is an object of this invention to facilitate restocking of shelf products behind front-of-shelf products. It is a further object of this invention to provide a product display hook rotatable to shift product from a vertical to a horizontal position to provide ready access to shelf space. Yet another object of this invention is to provide an adjustable display hook that can quickly be switched from a display position to a stock position in a simple one-handed operation.

SUMMARY OF THE INVENTION

A hook for displaying products in front of a shelf includes a bracket adapted to be mounted on the shelf. The bracket has a bearing, a stop and a detent. A journal is rotatable in the bearing between a product display position and a product clearing position. A product carrier connected to the journal will support products in a vertical hanging position in front of the shelf when the journal is in the display position. The stop on the bracket cooperates with the product carrier to prevent rotation of the journal beyond the display position. A prop connected to the journal cooperates with the carrier to support the products in a horizontal position in front of a shelf when the journal is rotated into the clearing position. The detent on the bracket is cooperable with the prop to prevent rotation of the journal out of the clearing position toward the display position. The prop may be disengaged from the detent to allow the journal to rotate back to the display position at the option of the user.

The bracket may further include a barrier which prevents rotation of the journal beyond the clearing position so that the product carrier cannot intrude substantially into the shelf space above when the carrier is rotated to the clearing position. A shield connected to the journal may also be provided which surrounds the carrier forward of the shelf. The free end of the carrier may be upturned to prevent inadvertent disengagement of product from the product carrier. The prop may also be sloped toward its midpoint to prevent product from slipping off the prop while in the clearing position.

In one preferred embodiment, a double bracket may be employed which may be inverted with the display frame insertable in the bracket in either its normal or its inverted position so that the display hook may be adapted to a greater number of front-shelf-face angle arrangements.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
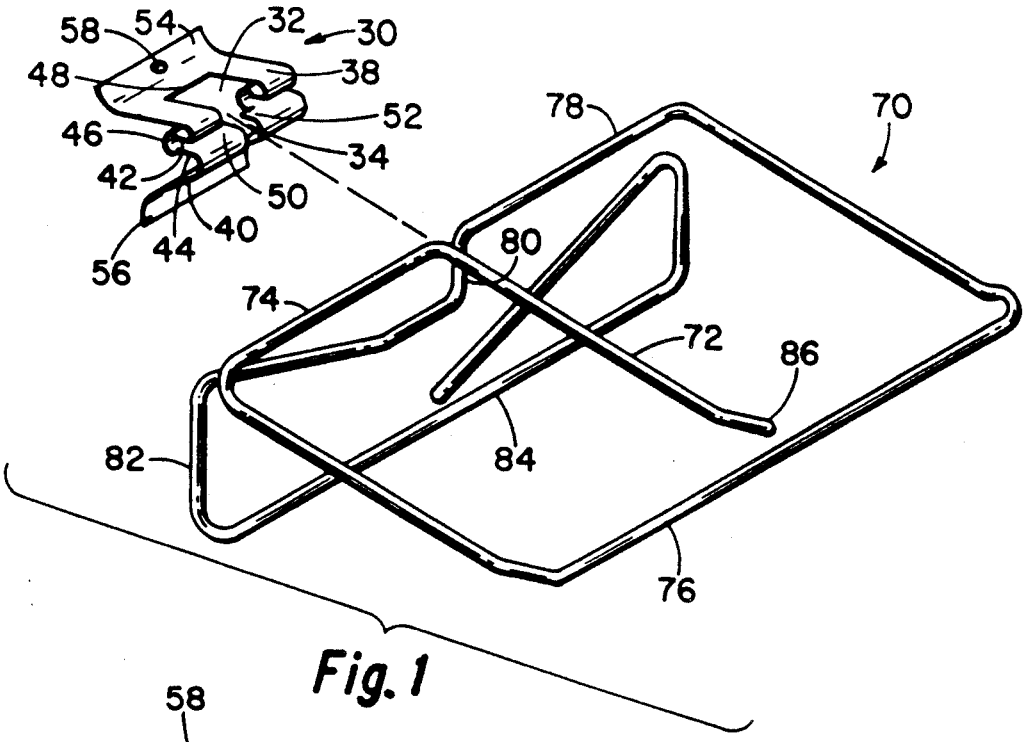
FIG. 1 is a perspective view illustrating a preferred embodiment of the bracket and frame of the present invention in an unassembled state.

The component parts of the front-of-shelf display hook are illustrated in FIG. 1 and include a bracket 30 and a frame 70.

Figure 2:
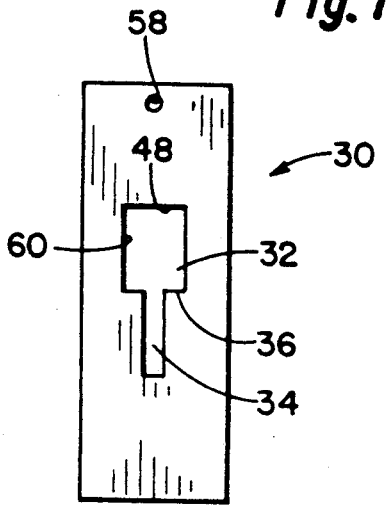
FIG. 2 is a plan view of a preferred embodiment of a bracket of the present invention in flattened out condition.

The bracket 30, in a preferred embodiment, will have an M-shaped configuration and having resilient properties as hereinafter explained. It may be formed from any suitable material, such as plastic or metal for example steel or aluminum. The flattened out configuration of the bracket 30 is illustrated in FIG. 2. As shown, the bracket 30 has a wide notch 32 and a narrow notch 34 joined a approximately the mid-point 36 of the bracket 30. The M-shaped bracket 30, when set in a sideways position as shown in FIG. 1, has an upper exterior leg 38 and a lower exterior leg 40, an upper interior leg 42 and a lower interior leg 44. The juncture of the interior legs 42 and 44 define a horizontal bearing 46. For reasons hereinafter explained, the depth of the leading edge 48 of the wide notch 32 is coordinated with respect to the depth of the horizontal bearing 46 in the bracket 30. The wide notch 32 and narrow notch 34 cooperate to define the first and second ledges 50 and 52 on the lower interior leg 44. The end portions 54 and 56 of the upper and lower exterior legs 38 and 40 are outwardly turned and the upper leg 38 may also be provided with a hole 58 at the midpoint of the end portion 54.

In a preferred embodiment, the frame 70 consists of an elongated rod of any suitable metal or plastic material bent to define a plurality of segments which substantially lie in one of two perpendicular planes formed at their juncture. In the preferred embodiment illustrated in FIG. 1, the rod has a first segment 72 perpendicular to the horizontal axis of the bracket bearing 46. A second segment 74 extends at right angles away from the first segment 72 to a third segment 76. The third segment 76 extends around to first segment 72 in substantially the plane defined by the segments 72 and 74 to a point approximately symmetrically opposite first segment 72 from the second segment 74. A fourth segment 78 extends toward but short of the juncture of segments 72 and 74. A fifth segment 80 extends perpendicular to the plane containing the first, second, third and fourth segment, 72, 74, 76 and 78. A sixth segment 82 extends in the plane defined by the segments 74, 78 and 80 to a point distant from the intersection of the two identified planes to a seventh segment 84 which extends parallel to the second and fourth segments 74 and 78. The segments 74 and 78 may be snapped into the bracket bearing 46 with the fifth segment 80 centered on the narrow notch 34. In this condition, the first segment 72 will extend adjacent one side 60 of the wide notch 32. The first ledge 50 will prevent rotation of the first segment 72 below horizontal. The frame 70 will be slightly distorted. That is, the frame 70 is flexed from its natural condition so that the fifth segment 80 is closer than normal to the first segment 72 and is therefore resiliently biased away from the first segment 72. From this position, if the frame 70 is upwardly rotated about the journal segments 74 and 78 disposed in the bearing 46, when the fifth segment 80 rotates beyond the second ledge 52 on the bracket 30, with the first segment 72 against the side 60 of the notch 32, the fifth segment 80 will be resiliently slid to a position over the second ledge 52, which then prevents rotation of the fifth segment 80 below the horizontal. As before noted, the leading edge 48 of the wide notch 32 is established at a depth which will prevent rotation of the first segment 72 to a point substantially beyond vertical.

Figure 3:
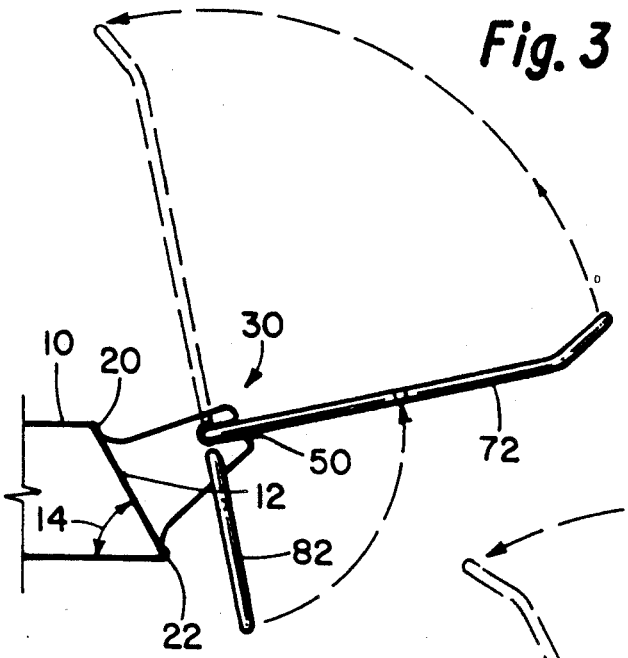
FIG. 3 is a cross-sectional view illustrating the preferred embodiment of the invention in a product display condition and showing a product clearing condition in dotted lines in relation to a shelf having a front face at an angle of 60°.
Figure 4:
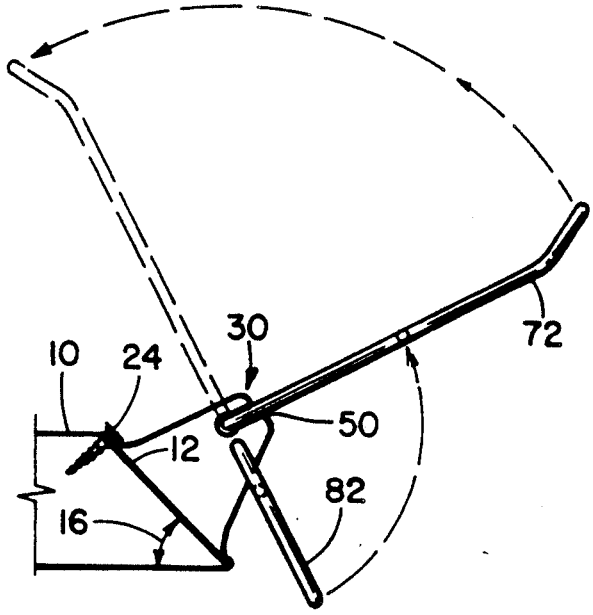
FIG. 4 is a cross-sectional view similar in all respects to that of FIG. 3 except the shelf face is disposed at 45°.
Figure 5:
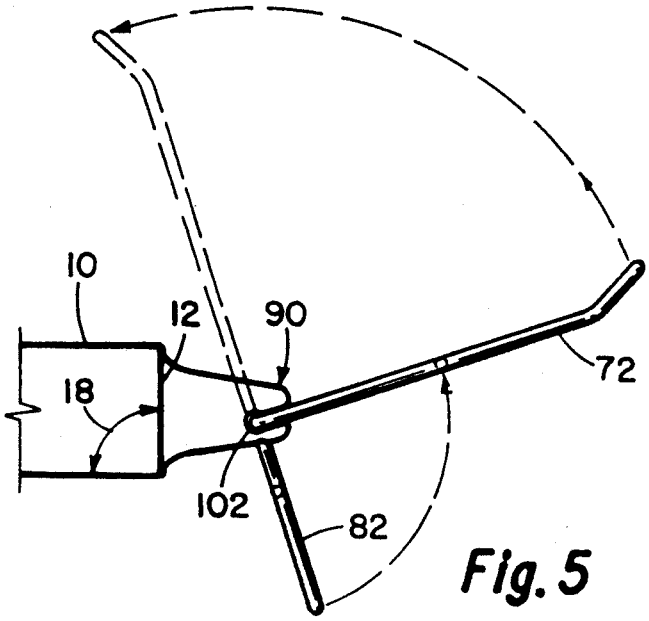
FIG. 5 is a cross-sectional view of an alternative embodiment of the invention employing a double invertible bracket illustrated with a shelf face at 90°.

FIGS. 3, 4, and 5 illustrate the use of the display hook in some typical store shelf arrangements. FIG. 3 illustrates a shelf 10 having a front face 12 mounted at a 60° angle 14. In FIG. 4 the angle 16 is 45° and in FIG. 5 the angle 18 is 90°. The front face 12 of a shelf frequently includes upper and lower channels 20 and 22 into which flexible price or identification tags are generally snapped. As shown in FIG. 3, the resilient bracket 30 may be slightly squeezed to allow insertion of the end portions 54 and 56 of the bracket within the channels 20 and 22 and released to resiliently couple the bracket 30 to the shelf 10. In addition, as shown in FIG. 4, a screw 24 may be inserted through the hole 58 in the bracket to secure the bracket to the shelf 10.

In operation, the first segment 72 serves as a product carrier from which selected products may be hung in a vertical position. As shown in FIGS. 3 and 4, the ledge 50 serves as a stop to prevent rotation of the product carrier 72 beyond what is called, though is not exactly, a horizontal condition. In this condition, the products are appropriately displayed for inspection by the consumer. When a stockboy desires to stock the shelves behind the products, he simply raises the product carrier 72 toward the vertical position. The second and fourth segments 74 and 78 serve as a journal in the bearing 46 so that as the first segment 72 is rotated the entire frame 70 rotates with it. As this occurs, the segment 72 will be rotated toward the dotted position shown, while the fifth, sixth and seventh segments 80, 82 and 84 are simultaneously rotated into the position formerly held by the product carrier 72. The seventh segment 84 becomes a product clearing means which cooperates with the carrier 72 from which the product is hanging to lift the product into an approximately horizontal condition clearing access to the shelf below. When the fifth segment 80 rotates past the second ledge 52, the resilient frame 70 expands, settling the fifth segment 80 over the second ledge 52, so that downward rotation of the frame 70 out of the product clearing position toward the product display position is prevented. Thus, the fifth segment 80 serves as a detent which the stockboy can compressively disengage from the second ledge 52 when his work is completed to return the product to the display position.

It will be seen from these figures that the vertical position of the carrier 72 is not truly vertical. The leading edge 48 of the wide notch 32 is established to prevent the rotation of the carrier 72 to a point substantially past vertical which would cause it to significantly intrude upon the shelf space above. As seen in FIGS. 3 and 4, by selecting an appropriate angular relationship between the leading edge 48 which forms a barrier to the carrier 72, the same bracket can be effectively used with either 60° or 45° shelf facing 12.

Figure 6:
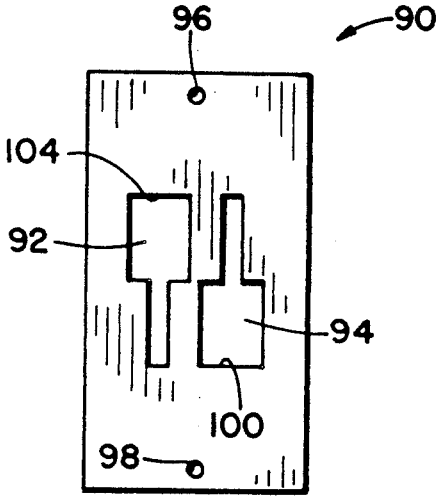
FIG. 6 is a plan view illustrating the bracket of FIG. 5 in a flattened out condition.

Furthermore, as illustrated in FIGS. 5 and 6, a double bracket 90 can be employed which has a first wide and narrow slot arrangement 92 similar in all respects to that of the previously described bracket 30 of FIG. 3, but also has a second wide and narrow notch configuration 94 similar to the first, but inverted. The bracket 90 may also be provided with mounting holes 96 and 98 similar to the bracket hole 58 of the other bracket 30. In this double bracket arrangement, the second wide notch is provided with a leading edge 100 also coordinated in angular relationship with respect to the bracket bearing 102. Thus, as shown in FIG. 5, when the bracket 90 is inverted, the frame 70 can be engaged with the bracket 90 with the fifth or detent segment 80 aligned with the narrow portion of the second notch 94. With the leading edge or barrier 100 of the second notch 94 established to function with a shelf having a 90° front face 12 and the leading edge 104 of the first notch 92 coordinated to handle shelf facing 12 at 60° or 45° angles, the same double bracket can be used to handle all three shelf arrangements or moderate variations of those arrangements.

Figure 7:
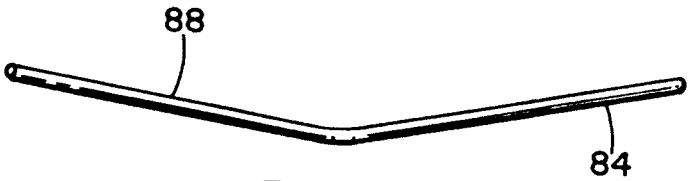
FIG. 7 is a front view of an alternative prop portion of the frame in the product clearing condition.

It will be noted that the third segment 76 serves as a guard laterally shielding the product carrier 72. Furthermore, the carrier 72 can be provided with an upturned portion 86 to prevent inadvertent slipping of displayed product from the carrier 72. In addition, as shown in FIG. 7, the seventh segment 84, which serves as the prop for the product in the clearing position, may be sloped toward a nadir 88 approximate its midpoint to insure that product in the clearing position will not slip off the prop 84.

While in the preferred embodiment, the frame 70 has been described as an integral elongated rod conformed to the necessary configuration, the frame 70 could be formed from separate pieces welded, glued or otherwise connected to form the necessary structure. Furthermore, the display hook can be used without the shield 76 and the prop 84 might consist of a plate rather than a rod.

Thus, it is apparent that there has been provided, in accordance with the invention, a product display hook that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A hook for displaying products in front of a shelf comprising:

bracket means adapted to be mounted on said shelf;

bearing means disposed on said bracket means;

journal means rotatable in said bearing means between a display position and a clearing position;

display means connected to said journal means for supporting the products in a vertical hanging position in front of the shelf when said journal means is in said display position; and clearing means connected to said journal means and cooperable with said display means for supporting the products in a horizontal position in front of the shelf when said journal means is in said clearing position.

2. A hook according to claim 1 further comprising means for preventing rotation of said journal means beyond said clearing position.

3. A hook according to claim 1 further comprising guard means laterally shielding said display means.

4. A hook according to claim 1 further comprising stop means for preventing rotation of said journal means beyond said display position.

5. A hook according to claim 1 further comprising releasable stop means for selectively preventing rotation of said journal means from said clearing position toward said display position.

6. A hook for displaying products in front of a shelf comprising:

bracket means adapted to be mounted on said shelf;

bearing means disposed on said bracket means;

journal means rotatable in said bearing means between a display position and a clearing position;

means for preventing rotation of said journal means beyond said clearing position;

stop means for preventing rotation of said journal means beyond said display position;

releasable stop means for selectively preventing rotation of said journal means from said clearing position toward said display position;

display means connected to said journal means for supporting the products in a vertical hanging position in front of the shelf when said journal means is in said display position; and clearing means connected to said journal means and cooperable with said display means for supporting the products in a horizontal position in front of the shelf when said journal means is in said clearing position.

7. A hook according to claim 6 further comprising guard means laterally shielding said display means.

8. A hook for displaying products in front of a shelf comprising:

a bracket adapted to be mounted on said shelf, said bracket having a bearing, a stop and a detent;

a journal rotatable in said bearing between a display position and a clearing position;

a product carrier connected to said journal for supporting the products in a vertical hanging position in front of the shelf when said journal is in said display position, said stop being cooperable with said product carrier to prevent rotation of said journal beyond said display position; and a prop connected to said journal and cooperable with said carrier for supporting the products in a horizontal position in front of the shelf when said journal is in said clearing position, said detent being cooperable with said prop to selectively prevent rotation of said journal from said clearing position toward said display position.

9. A hook according to claim 8, said bracket having a barrier for preventing rotation of said journal beyond said clearing position.

10. A hook according to claim 8 further comprising a shield connected to said journal for hemming said carrier forward of the shelf.

11. A hook for displaying products in front of a shelf comprising:

an M-shaped bracket having lower exterior legs adapted to be connected to a front face of said shelf with one of said exterior legs above the other, interior legs adapted at a junction thereof to form a horizontal bearing, a narrow notch in the bottom one of said exterior legs and the one of said interior legs connected thereto and a wide notch in the upper one of said exterior legs and the one of said interior legs connected thereto, said notches meeting at said junction to form first and second ledges on either side thereof; and an elongated rod having bends therein determining sequential segments of said rod including a first segment extending adjacent one side of said wide notch and perpendicular to said horizontal bearing, a second segment extending through said bearing away from said notches, a third segment extending around said first segment to a point on an axis of said bearing opposite said bracket from the end of said second segment, a fourth segment extending through said bearing toward said notches, a fifth segment extending adjacent the other side of said wide notch and perpendicular to a plane defined by said first, second, third and fourth segments, a sixth segment extending in plane defined by said second, fourth and fifth segments and a seventh segment extending parallel to and spaced apart from said second and fourth segments, said second and fourth segments being journalled for rotation in said bearing, said first ledge being aligned with said first segment to prevent rotation of said first segment below horizontal and said second ledge being aligned with said fifth segment to prevent rotation of said fifth segment below horizontal, said rod being resiliently flexible to permit selective alignment of said fifth segment with said narrow notch to permit rotation of said fifth segment below horizontal.

12. A hook according to claim 11, said seventh segment sloping from its ends to a nadir proximate its midpoint.

13. A hook according to claim 11, said first segment having a free end upturned in relation to said plane which it defines.

14. A hook according to claim 11, said wide notch having an edge in said upper exterior bracket leg forming a barrier for preventing rotation of said first segment substantially beyond vertical.

15. A hook according to claim 14, said bracket having second wide and narrow notches in side by side inverted relationship to said first wide and narrow notches and being resiliently flexible whereby said second and fourth segments are selectively removable from and reinsertable into said bearing with said bracket inverted, said second wide notch having an edge in said lower exterior bracket leg forming a second barrier for preventing rotation of said first segment substantially beyond vertical, said first and second barriers being disposed at preselected different angular relationships with respect to said bearing whereby said hook may be used with shelves having front faces disposed at any of several preselected angles.

* * * * *